US005601095A

United States Patent [19]

Bright

[11] Patent Number: 5,601,095

[45] Date of Patent: Feb. 11, 1997

[54] CIGARETTE DISPOSAL BIN

[76] Inventor: Martyn A. Bright, 64, Margaret Road, New Barnet, Herts, EN4 9NX, England

[21] Appl. No.: 247,140

[22] Filed: May 20, 1994

[30] Foreign Application Priority Data

Oct. 11, 1993 [GB] United Kingdom ..... 9320885
Mar. 4, 1994 [GB] United Kingdom ..... 9404224

[51] Int. Cl.[6] ..... A24F 19/14

[52] U.S. Cl. ..... 131/235.1; 131/236; 131/231

[58] Field of Search ..... 131/235.1, 256, 131/236, 231

[56] References Cited

U.S. PATENT DOCUMENTS

| | | | |
|---|---|---|---|
| Re. 24,721 | 5/1953 | Aghnides | 131/235.1 |
| D. 330,446 | 10/1992 | Verzicco et al. | D34/1 X |
| 3,524,584 | 8/1970 | Vevirit et al. | 232/43.2 |
| 3,591,073 | 7/1971 | Dennis | 232/43.2 |
| 4,018,235 | 4/1977 | Smith | 131/236 |
| 4,221,442 | 9/1980 | Harangozo | 312/294 |
| 5,027,948 | 7/1991 | Forbes et al. | 232/43 |

FOREIGN PATENT DOCUMENTS

| | | | |
|---|---|---|---|
| 2803820 | 1/1978 | Germany . | |
| 320843 | 4/1928 | United Kingdom | 131/236 |
| 331249 | 6/1930 | United Kingdom | 131/231 |
| 346418 | 1/1933 | United Kingdom | D27/104 X |
| 414786 | 2/1933 | United Kingdom | 131/236 |
| 414224 | 8/1934 | United Kingdom | 131/231 |
| 2124070 | 5/1983 | United Kingdom | 131/236 |
| 2251545 | 11/1990 | United Kingdom | 131/236 |

OTHER PUBLICATIONS

Concise English-language translation of German-language Patent Document 28 03 820.

*Primary Examiner*—V. Millin
*Assistant Examiner*—Charles W. Anderson
*Attorney, Agent, or Firm*—Klarquist Sparkman Campbell Leigh & Whinston, LLP

[57] ABSTRACT

A cigarette disposal bin comprising;

an outer shell formed with at least one aperture through which a cigarette may be inserted into the bin;

a separate collection device located within the outer shell for collecting cigarettes inserted into the bin;

a baffle provided within the bin below the at least one aperture; and a stubbing out portion located adjacent the at least one aperture such that ash falling from a cigarette when stubbed out on the stubbing out portion falls through the at least one aperture into the cigarette disposal bin, the baffle preventing smoke from a cigarette from escaping through the at least one aperture and for extinguishing a cigarette in the collection device, which baffle defines an opening into the collection device, the collection device retaining cigarettes in the cigarette disposal bin when the cigarette disposal bin is opened.

9 Claims, 4 Drawing Sheets

CIGARETTE DISPOSAL BIN

FIELD OF THE INVENTION

THE PRESENT INVENTION relates to a bin for collecting cigarette stubs, hereinafter called a cigarette disposal bin. The invention also relates to a cigarette disposal bin formed with an area adapted for stubbing out cigarettes for disposal in the bin.

DESCRIPTION OF THE BACKGROUND ART

Conventional cigarette disposal bins, which may be, for example, mounted on walls or upon stands, have a front facia which is hinged towards the top of the bin such that the interior of the bin can be accessed by hinging the front facia open. The conventional bins have a sloping bottom such that the cigarettes which have been placed inside the disposal bin automatically slide out from the bin when the front facia is opened. The person emptying the bin has no control over the emptying of the bin and, when it is windy or when the bin is extremely full, the ash and cigarettes within the disposal bin may not fall neatly within a collection bin but may fall or be blown on to the floor thus creating a mess on the floor area around the cigarette disposal bin.

Conventional cigarette disposal bins have a planar front facia formed with a series of apertures. Many smokers stub out their cigarettes on the cigarette disposal bins before placing their cigarette in the disposal bin, thus creating a certain amount of ash and debris around the cigarette disposal bin.

It is an object of the present invention to provide a means for reducing the amount of ash and debris around a cigarette disposal bin.

Accordingly, one aspect of the present invention provides a cigarette disposal bin comprising an outer shell formed with at least one aperture through which a cigarette may be inserted into the bin, a separate collection device located within the outer shell for collecting cigarettes inserted into the bin, a baffle provided within the bin below the at least one aperture for preventing smoke from a cigarette from escaping through the at least one aperture and for extinguishing a cigarette in the collection device, which baffle defines an opening into the collection device, the collection device retaining cigarettes in the cigarette disposal bin when the cigarette disposal bin is opened.

A further aspect of the present invention provides a cigarette disposal bin comprising an outer shell formed with at least one aperture through which a cigarette may be inserted into the bin, a stubbing out portion located adjacent the at least one aperture such that ash falling from a cigarette when stubbed out on the stubbing out portion falls through the at least one aperture into the cigarette disposal bin.

BRIEF DESCRIPTION OF THE DRAWINGS

In order that the present invention may be more readily understood, embodiments thereof will now be described, with reference to the accompanying drawings, in which.

DETAILED DESCRIPTION OF EMBODIMENTS OF THE INVENTION

Figure 1:
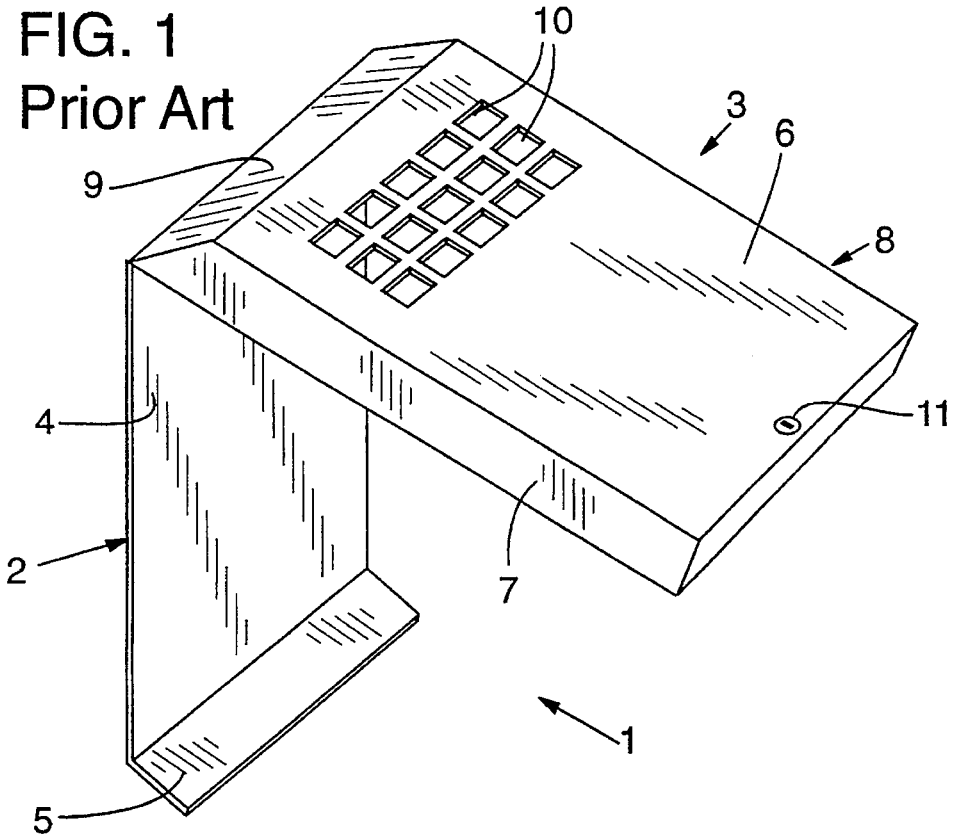
FIG. 1 Prior Art
FIG. 1 is a perspective view of a conventional cigarette disposal bin formed with a sloped bottom.

Referring to FIG. 1, a conventional cigarette disposal bin comprises a substantially rectangular bin 1 suitable for either mounting on a wall or on a free-standing support to receive cigarette stubs. The bin 1 is manufactured from, for example, stainless steel sheet blanks which are folded and welded into the desired configuration.

The conventional bin 1 comprises a back plate 2 which is disposed substantially vertically in use, and a front facia 3 which is hingedly mounted on the back plate 2 at a top edge thereof. The back plate 2 consists of a back sheet 4 and a bottom plate 5. The bottom plate 5 slopes downwardly and away from the back sheet 4 at an angle of approximately 135°. The front facia 3 comprises a front plate 6 formed with two orthogonal side walls 7,8 and a sloping top plate 9 such that the front facia 3 closes upon the back plate 2 to define a closed shell or bin 1.

The front plate 6 is formed with an array of apertures 10 near its upper half which are dimensioned to receive a cigarette stub to be disposed of within the cigarette disposal bin 1.

The front plate 6 is formed with a lock 11 which locks the front facia 3 to the back plate 2 or to the side walls 3,4 to prevent accidental or unauthorised opening of the cigarette disposal bin 1.

To empty the conventional cigarette disposal bin 1 the lock 11 is unlocked and the front facia 3 is hinged forward with respect to the back plate 2. Cigarette stubs and cigarette ash resting on the sloping bottom plate 5 fall from the cigarette disposal bin 1 into a waiting bin for subsequent disposal. In general, the cigarette disposal bins are provided outdoors and hence, if it is windy, and the front facia is open, the wind may catch the cigarettes and ash falling from the cigarette disposal bin and disperse them in the area surrounding the cigarette disposal bin, thereby creating an unsightly mess which is difficult to clean up. Similarly, if the bin is extremely full and the front facia 3 is opened then the volume of ash and cigarettes may not be containable in the collection bin and may spill on to the floor, again creating an unsightly mess.

To obviate this problem, a cigarette disposal bin 1 embodying the present invention is provided which has a collection device 12 located within the bin 1. The collection device 12, in one embodiment, is formed as a rectangular box 12 having an open upper end. The rectangular box 12 is dimensioned to fit inside a cigarette disposal bin 1 and to rest upon a substantially horizontal bottom plate 5 with which the cigarette disposal bin 1 is provided.

Cigarettes to be disposed of in the cigarette disposal bin 1 are pushed through the array of apertures 10 and drop into the collection device 12. Upon opening the front facia 6 of the cigarette disposal bin 1 to empty the cigarette disposal bin, no cigarettes are therefore able to fall automatically from the cigarette disposal bin 1, thus giving the person emptying the cigarette disposal bin an opportunity to empty the bin without creating an unsightly mess on the floor area around the bin 1.

Figure 2:
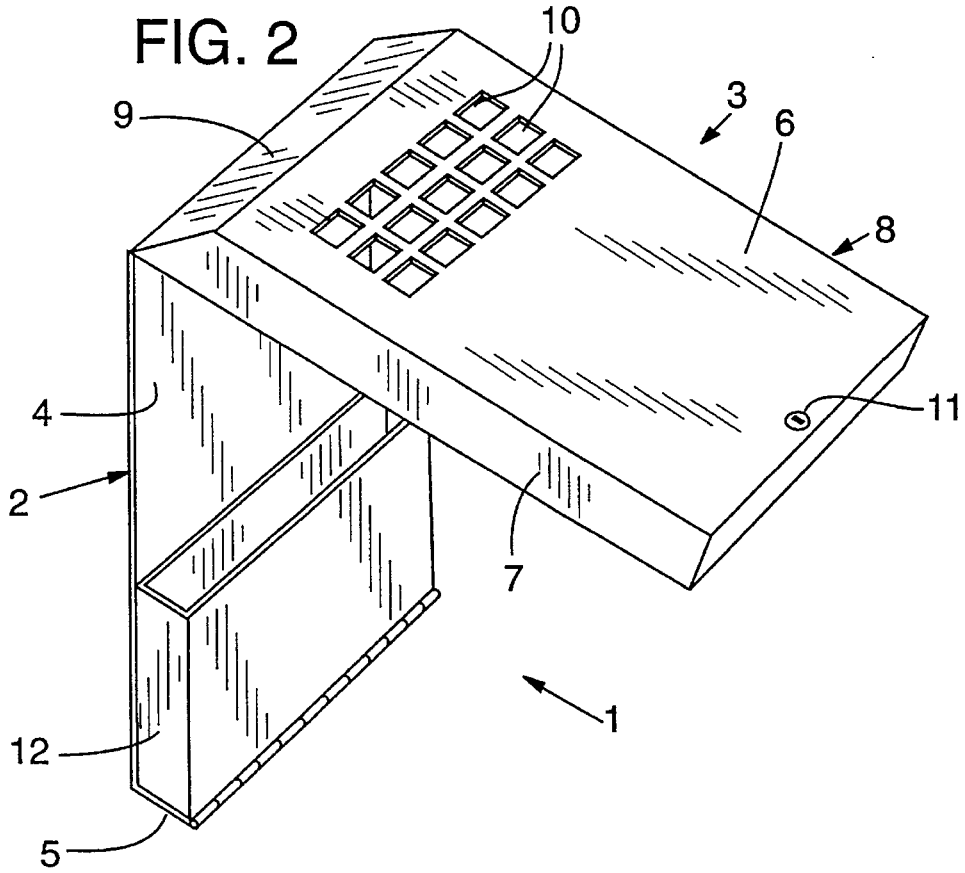
FIG. 2 is a perspective view of a collection device installed in a cigarette disposal bin embodying the present invention.

In the embodiment shown in FIG. 2, the collection device 12 is hingedly mounted on the bottom plate 5 of the cigarette disposal bin 1 such that, to empty the collection device 12, the collection device 12 is tilted forward thereby discharging the cigarettes and ash held in the collection device 12.

Figure 3:
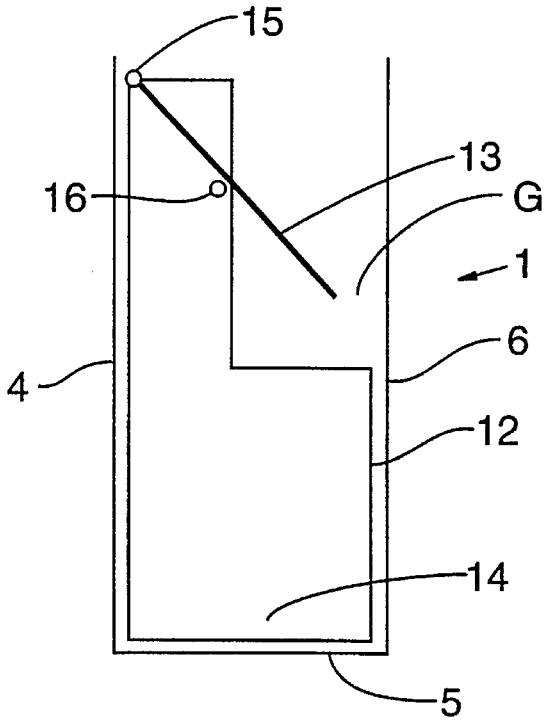
FIG. 3 is a schematic cross-section through a collection device installed in a cigarette disposal bin embodying the present invention, only the lower half of the disposal bin being shown.

In the embodiment of the present invention shown in FIG. 3, the collection device 12 within the cigarette disposal bin 1 is formed with a baffle 13 such that cigarettes disposed of in the cigarette disposal bin 1 hit the baffle 13 above a collection area 14 of the collection device 12, fall down the length of the baffle 13 through a narrow gap G between the baffle 13 and the front facia 6 before coming to rest in the collection area 14 of the collection device 12. The provision of the baffle 13 helps keep down the amount of smoke and facilitates the extinguishing of the disposed of cigarettes. In the embodiment shown in FIG. 3, the baffle 13 is hingeably mounted on the collection device 12 by a hinge 15. The baffle 13 is prevented from falling into a fully vertical position by a stopper 16 mounted on a side wall of the collection device 12 which holds the baffle 13 at an angle of approximately 45° to the back plate 2 of the cigarette disposal bin 1.

Figure 4:
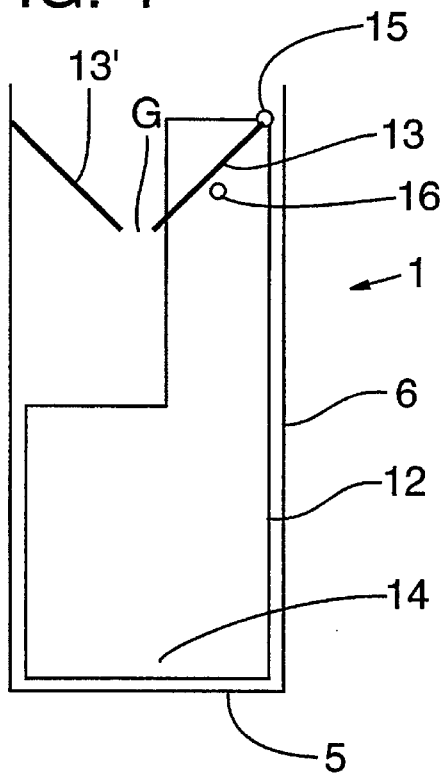
FIGS. 4, 5 and 6 are cross-sections through respective further forms of collection device installed in a cigarette disposal bin embodying the present invention.
Figure 5:
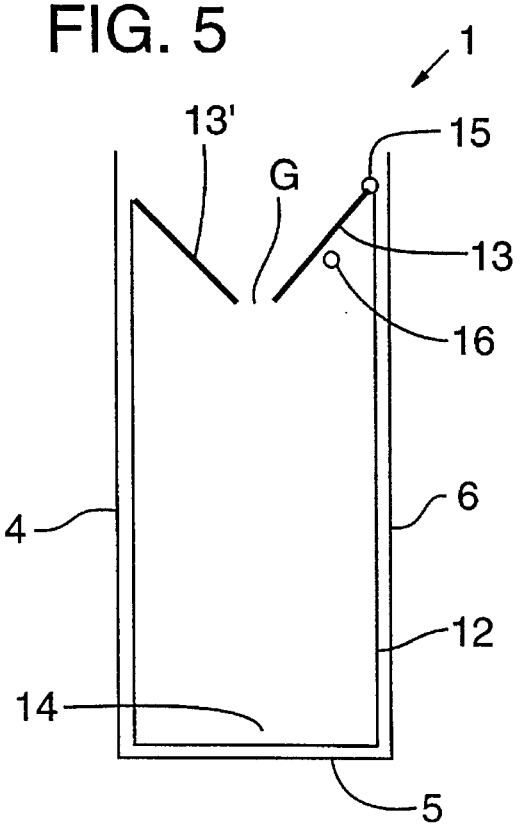
Figure 6:
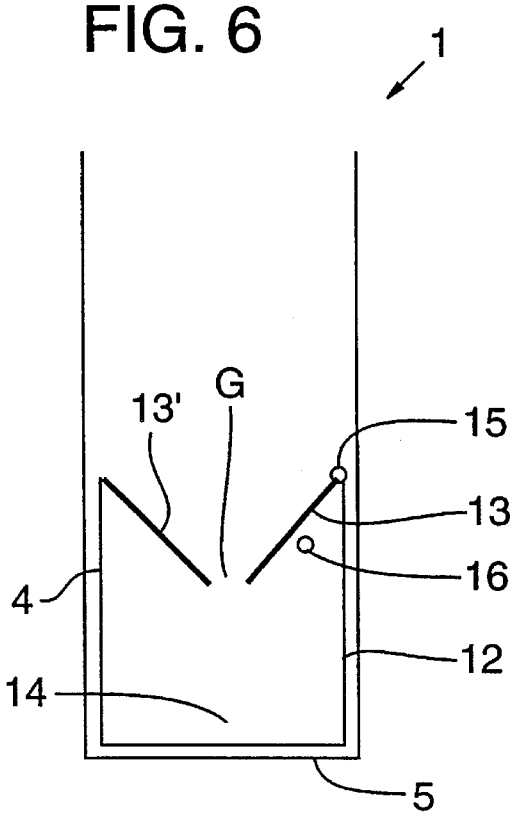

Variations on the embodiment of the invention shown in FIG. 3 are shown in FIGS. 4, 5 and 6. FIG. 4 shows a collection device 12 formed with a single hingeably mounted baffle 13, the cigarette disposal bin 1 itself being formed with a second rigidly mounted baffle 13'. FIG. 5 shows a collection device 12 formed with a single hingeable baffle 13 and a second rigidly mounted baffle 13'. FIG. 6 shows a shorter collection device 12 than that shown in FIG. 5 which is also formed with a single hingeably baffle 13' and a second rigidly mounted baffle 13. The hingedly mounted baffles 13 help by hinging open when the collection device 12 is turned upside down to allow the cigarettes and ash to fall freely from the collection device into a waiting collection container.

The collection devices 12 can be used with a hingeably opening cigarette disposal bin 1 as illustrated in FIG. 2 but in a further embodiment (shown in FIG. 7) the bottom plate 5 of the cigarette disposal bin 1 is removed entirely and is, instead, formed by a bottom plate of the collection device 12. The collection device 12 is locked into position and supported in the cigarette disposal bin by a cam or lock 17 on the collection device 12. The lock 17 engages with a striking plate 18 formed on the back sheet 4. The collection device 12 is removed from the cigarette disposal bin 1 by unlocking the lock 17, thereby disengaging the cam from the striking plate 18 so that the cigarette collection device 12 falls through the bottom of the cigarette disposal bin 1 and can then be manually emptied into an awaiting collection bin by the person emptying the cigarette disposal bin 1.

Figure 7:
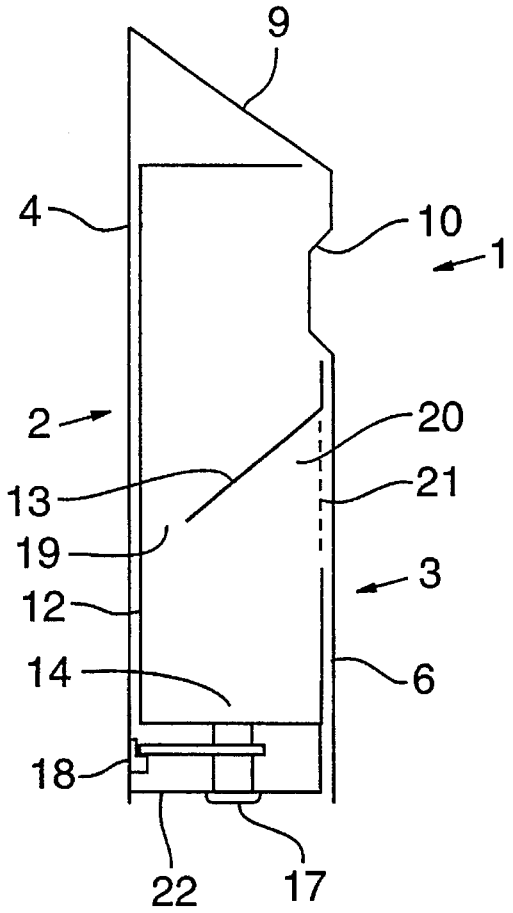
FIG. 7 is a perspective view of a preferred embodiment of a cigarette disposal bin according to the present invention.

In a preferred embodiment of the present invention shown in FIG. 7, the collection device 12 comprises a substantially rectangular box having a first opening 19 adjacent the array of apertures 10, when the collection device 12 is located in the cigarette disposal bin 1. A baffle 13 is formed in the collection device 12 below the array of apertures 10. The wall of the collection device 12 underneath an eave 20 defined by the baffle 13 is formed with a second opening 21. The bottom surface of the collection device 12 has a lock shield plate 22 on its underside. The lock shield plate 22 houses a key-operated lock 17 which is mounted between the bottom surface of the collection device 12 and the lock shield plate 22. When the cam of the lock 17 is rotated by a key, the cam engages with a striking plate 18 mounted on the back sheet 4 to prevent the collection device 12 from dropping from the cigarette disposal bin 1.

In operation, cigarettes to be disposed of are inserted into the bin 1 through the array of apertures 10, fall on to the baffle 13, through the first opening 19 and accumulate in the collection device 12. To empty the collection device 12, a key is inserted in the lock 17 and turned through 90° to disengage the cam of the lock 17 from the striking plate 18. The collection device 12 is then free to fall from the cigarette disposal bin 1. Advantageously, the lock 17 is situated on the bottom of the collection device 12 so that a person opening the bin with a key can support the collection device 12 manually when it is unlocked. Additionally, the lock 17 is concealed in this position, thus preventing tampering. When released from the bin 1, the collection device 12 can be inverted so that the accumulated ash and cigarettes fall through the second opening 21 into a suitable collection container.

To reinsert the emptied collection device 12 into the bin 1, the collection device 12 is pushed upwardly into the bin, the wall of the collection device 12 adjacent the back sheet 4 passing over the striking plate 18. The collection device is locked into position by engaging the cam of the lock 17 with the striking plate 18.

By removing the requirement for the cigarette collection bin 1 to have a bottom plate 5, fewer welded joints and less folding of the sheet material are required to manufacture the cigarette disposal bin. Thus, this embodiment of cigarette disposal bin 1 is simpler to make requiring fewer manufacturing steps.

Figure 9:
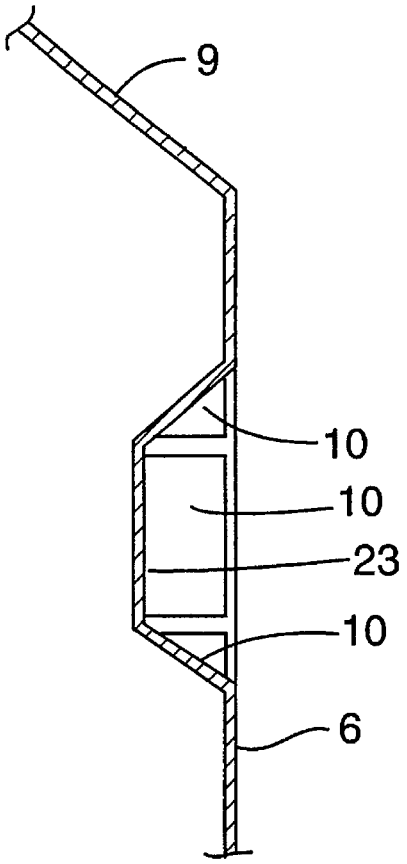
FIG. 9 is an enlarged side cross-section along the line IX—IX through the stub-out portion shown in FIG. 8.
Figure 8:
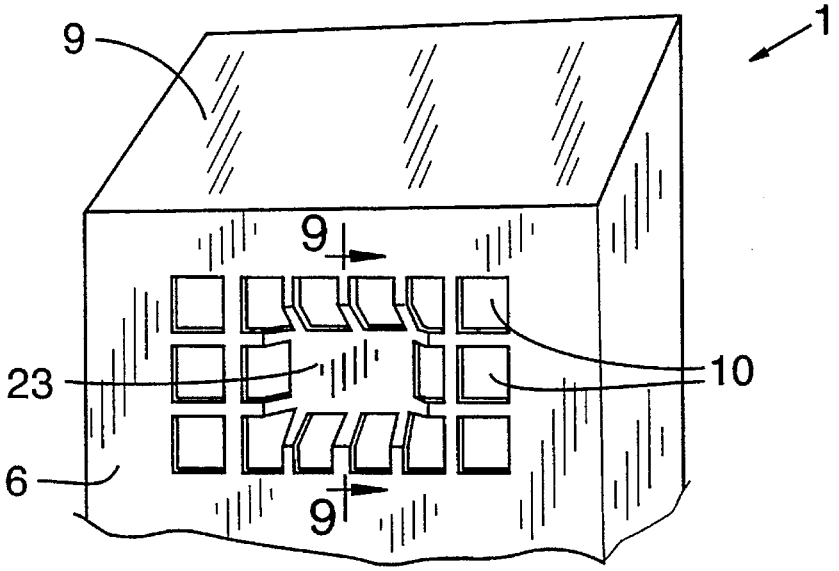
FIG. 8 is a perspective front view of a stub-out portion formed on a cigarette disposal bin embodying the present invention.

In a further embodiment of the present invention, as shown in FIGS. 8 and 9, a central area within the array of apertures 10 in the upper half of the front facia 3 of the cigarette disposal bin 1 is recessed into the bin 1, and is not provided with any apertures, so as to form a recessed stubbing out area 23 encircled by apertures 10. Accordingly, ash from a cigarette stubbed out on the recessed area 23 falls directly into the bin 1 through the apertures 10 surrounding the central area 23 rather than onto the floor surrounding the bin, thereby further preventing the creation of an unsightly mess in the floor area around the cigarette disposal bin 1.

Preferably, the depressed area upon which the cigarettes are stubbed out is of a stainless steel finish, which finish is easy to clean thereby improving the appearance of the cigarette disposal bin.

Figure 10:
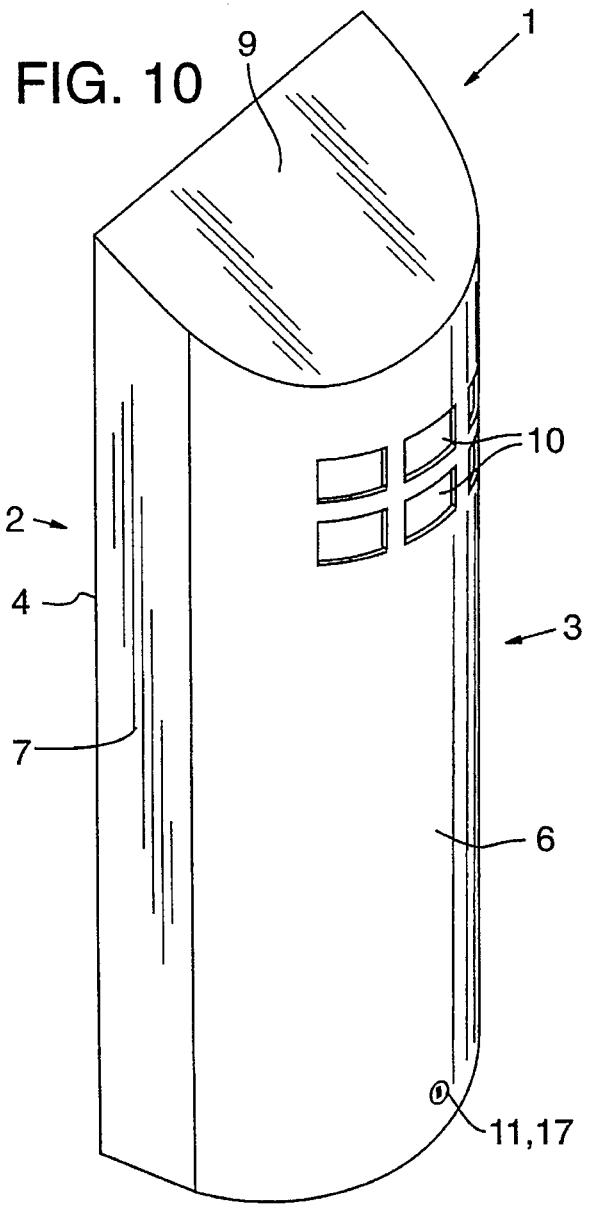
FIG. 10 shows another embodiment of a cigarette disposal bin according to the present invention.

In another embodiment of the present invention the cigarette disposal bin 1 is designed to resemble an upright cigarette, as shown in FIG. 10, to facilitate recognition of the bin as a cigarette disposal bin.

The cigarette bins shown in FIGS. 1 to 10 are primarily for use in outdoor areas where smokers are likely to congregate. For buildings in which smoking is permitted, it is desirable to provide cigarette disposal bins which are specially adapted for internal use. The aforementioned bins for outdoor use are provided with one or two baffles 13,13' to keep down the amount of smoke escaping from the bin. However, inside buildings it is desirable to enhance this property of the bin due to the presence of smoke alarms in the building which could be activated by excessive smoke emanating from the bins.

Figure 11:
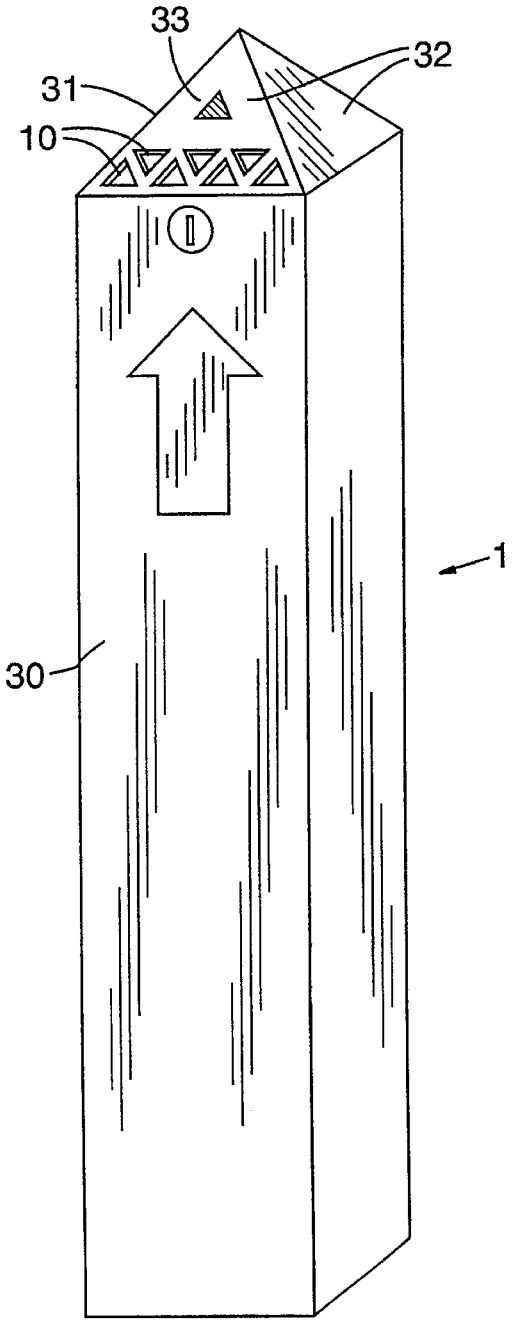
FIG. 11 shows a further embodiment of a cigarette bin according to the present invention.

FIG. 11 shows a bin 1 embodying the present invention which has been specially adapted for use indoors. The bin 1 comprises a free-standing elongate hollow tower 30 housing a collection device 12 which has already been described. A pyramidic top 31 having four sloped triangular faces 32 is provided on the top of the tower 30. One or more of the triangular faces 32 of the top 31 is formed with an array of apertures 10 similar to those formed in the bin shown in FIGS. 1 to 10 but triangular in configuration. Another aperture 33 in one of the faces 32 is covered with a wire mesh such that a cigarette can be stubbed out on the wire mesh allowing the ash to fall into the collection device 12 and the cigarette butt can then be inserted into one of the other apertures 10. In this manner, the cigarette butt is already substantially extinguished prior to insertion through an aperture 10 and therefore gives off less smoke when in the collection device 12.

To reduce further the amount of smoke emanating from the indoor bin 1 shown in FIG. 11, additional baffles 13" can be provided inside the tower 30. Such baffles 13" are spaced apart from one another along the longitudinal axis of the tower 30 and provided on alternate upright walls of the tower 30.

What is claimed is:

1. A cigarette disposal bin comprising:

an outer, vertically walled shell having a predetermined horizontal cross-sectional area, and defining at least one aperture through which a cigarette may be inserted into the bin;

a separate collection device located within the outer shell below the at least one aperture for collecting cigarettes inserted into the bin; and an inclined baffle means mounted within the outer shell below the at least one aperture in a position to direct cigarettes inserted through the at least one aperture into said collection device, the baffle means having a lower edge defining an opening into the collection device, the opening having a cross-sectional area that is of dimension sufficient to permit a cigarette inserted into the bin through said at least one aperture to slide into said collection device but that is substantially less than said predetermined horizontal cross-sectional area of the outer shell thereby to restrict circulation of air into said collection device thereby promoting extinguishment of a cigarette in the collection device and restricting the escape of smoke from a cigarette in the collection device through the at least one aperture, the collection device retaining cigarettes in the cigarette disposal bin.

2. A cigarette disposal bin according to claim 1 wherein the collection device comprises a box dimensioned to be received within said shell, the shell comprising a first portion hingedly connected to a second portion, to allow access to the collection device.

3. A cigarette disposal bin according to claim 1, wherein the collection device comprises a box dimensioned to be received within said outer shell, the bottom surface of the collection device comprising the bottom surface of the cigarette disposal bin and lock means operatively engaging said shell and said box and operable selectively to retain said box within said shell or to release said box whereby it may drop from said shell.

4. A cigarette disposal bin according to claim 1, wherein the baffle means has an upper edge hingedly mounted on the collection device whereby, when the collection device is removed from the cigarette disposal bin, the collection device can be tilted upside down allowing the hinged baffle to open thereby allowing discarded cigarettes to be emptied from the collection device.

5. A cigarette disposal bin according to claim 1, wherein a stubbing out portion is provided on said shell located adjacent the at least one aperture such that ash falling from a cigarette when stubbed out on the stubbing out portion falls through the at least one aperture into the cigarette disposal bin.

6. A cigarette disposal bin according to claim 1, wherein a stubbing out portion is provided on the bin and comprises a second aperture covered with a wire mesh such that a cigarette being stubbed out on the mesh would be at least partially extinguished and ash falling from the stubbed out cigarette would fall through said second aperture.

7. A cigarette disposal bin comprising:

an outer shell formed with at least one aperture through which a cigarette may be inserted into the bin;

a separate collection device located within the outer shell for collecting cigarettes inserted into the bin;

an inclined baffle provided within the bin below the at least one aperture and above said collection device, the baffle having a lower edge spaced from said outer shell and defining with said outer shell an opening into the collection device, the opening having a cross-sectional area that is of dimensions sufficient to permit a cigarette inserted into the bin through said aperture to slide into said collection device but that is substantially less than said predetermined horizontal cross-sectional area of the outer shell; and a stubbing out portion defined by a recessed portion of said outer shell adjacent the at least one aperture such that ash falling from a cigarette when stubbed out on the stubbing out portion falls through the at least one aperture into the cigarette disposal bin, whereby the baffle inhibits smoke from a cigarette from escaping through the at least one aperture and restricts circulation of air into said collection device thereby promoting the extinguishment of a cigarette in the collection device, the collection device retaining cigarettes in the cigarette disposal bin.

8. A cigarette disposal bin comprising:

an outer, vertically walled shell having a predetermined horizontal cross-sectional area, and defining at least one aperture through which a cigarette may be inserted into the bin;

a separate collection device comprising a box having first and second opposed vertical walls, located within the outer shell below the at least one aperture for collecting cigarettes inserted into the bin;

a first inclined baffle mounted on said first box wall and a second inclined baffle mounted on said second box wall below the at least one aperture, means operatively arranged between said box and said baffles to retain, in the operative position of said box, said first and second baffles sloping downwardly from said first and second walls toward one another, the lower edges of said first and second baffles defining an opening into the collection device, the opening having a cross-sectional area that is of dimension sufficient to permit a cigarette inserted into the bin through said aperture to slide into said collection device but that is substantially less than said predetermined horizontal cross-sectional area of the outer shell thereby to restrict circulation of air into said collection device thereby promoting extinguishment of a cigarette in the collection device and restricting the escape of smoke from a cigarette in the collection device through the at least one aperture, the collection device retaining cigarettes in the cigarette disposal bin.

9. A cigarette disposal bin as set forth in claim 8 wherein at least one of said baffles is hingedly mounted to a box wall for swinging movement toward the top of said box whereby when said box is inverted, the contents of said box may fall therefrom.

* * * * *

UNITED STATES PATENT AND TRADEMARK OFFICE

CERTIFICATE OF CORRECTION

PATENT NO. : 5,601,095

DATED : February 11, 1997

INVENTOR(S) : Martyn A. Bright

It is certified that error appears in the above-identified patent and that said Letters Patent is hereby corrected as shown below:

ON THE TITLE PAGE:
Item [56]

In the References Cited:

--1,791,243 2/1931 Horch.....232/21--.

Signed and Sealed this

Seventeenth Day of February, 1998

Bruce Lehman

*Attest:*

BRUCE LEHMAN

*Attesting Officer*

*Commissioner of Patents and Trademarks*